US010918259B2

(12) United States Patent
Singhal et al.

(10) Patent No.: US 10,918,259 B2
(45) Date of Patent: Feb. 16, 2021

(54) DISHWASHER APPLIANCE WITH A LEAK PAN

(71) Applicant: Haier US Appliance Solutions, Inc., Wilmington, DE (US)

(72) Inventors: Arpit Singhal, Firozabad (IN); Brian Steven Riddle, Taylorsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 107 days.

(21) Appl. No.: 16/244,175

(22) Filed: Jan. 10, 2019

(65) Prior Publication Data

US 2020/0221922 A1 Jul. 16, 2020

(51) Int. Cl.
*A47L 15/42* (2006.01)

(52) U.S. Cl.
CPC ..... *A47L 15/4272* (2013.01); *A47L 15/4253* (2013.01)

(58) Field of Classification Search
CPC ..... A47L 15/4212; A47L 15/4253; A47L 15/4272; A47L 15/427; A47L 15/4251; A47L 15/4246; A47L 15/00–508; D06F 39/125; A47B 91/02–098
See application file for complete search history.

(56) References Cited

U.S. PATENT DOCUMENTS 5,230,553 A * 7/1993 Tuller ..... A47L 15/4246 312/228
7,699,064 B2 4/2010 Schlief
2002/0139908 A1* 10/2002 Oyama ..... D06F 39/125 248/188.8
2009/0039216 A1* 2/2009 Kwon ..... D06F 39/125 248/188.3
2010/0243661 A1* 9/2010 Upham ..... F24H 9/165 220/571
2010/0276564 A1* 11/2010 Fetzer ..... D06F 39/125 248/678
2017/0074719 A1* 3/2017 Izumo ..... G01G 23/00

FOREIGN PATENT DOCUMENTS

EP 1633218 B1 8/2007
JP 3746930 B2 2/2006

* cited by examiner

*Primary Examiner* — Michael E Barr
*Assistant Examiner* — Omair Chaudhri
(74) *Attorney, Agent, or Firm* — Dority & Manning, P.A.

(57) ABSTRACT

A dishwasher appliance includes a tub. A leak pan is positioned below the tub. A leveling assembly is configured for adjusting a level of the tub. The leveling assembly includes a housing mounted to the leak pan. A leveling leg is positioned within the housing. The leveling leg has a foot. An axle is mounted to the leak pan. A gear set is positioned within the housing. The gear set is configured to transfer rotation of the axle through the gear set to the leveling leg to adjust the level of the tub. The foot of the leveling leg is spaced from a thread on an outer surface of the leveling leg such that the gear set unmeshes from the thread on the outer surface of the leveling leg when the leveling leg is fully retracted.

19 Claims, 9 Drawing Sheets

DISHWASHER APPLIANCE WITH A LEAK PAN

FIELD OF THE INVENTION

The present subject matter relates generally to dishwasher appliances with leak pans.

BACKGROUND OF THE INVENTION

Certain dishwasher appliances include a plastic base beneath a tub. The plastic base supports the tub and can include a leveling assembly. Dishwasher appliances with such plastic bases suffer several drawbacks.

The plastic base is generally connected to the tub at side edges of the plastic base, and the leveling assembly is positioned away from the side edges of the plastic base. Thus, the weight of the tub transfers through the sides of the plastic base and then away from the sides towards the leveling assembly. Such construction generates cantilever loading that undesirably deforms the plastic base on its sides.

Another drawback is gear stripping. The leveling assembly in known dishwasher appliances includes gears that rotate to extend and retract the leveling assembly. When the leveling assembly is fully retracted and a user attempts further retraction by rotating the gears of the leveling assembly, the gears can strip and prevent proper operation of the leveling assembly.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance includes a tub. A leak pan is positioned below the tub. A leveling assembly is configured for adjusting a level of the tub. The leveling assembly includes a housing mounted to the leak pan. A leveling leg is positioned within the housing. The leveling leg has a threaded outer surface and a foot. A spur gear is positioned within the housing. An inner thread of the spur gear meshes with the threaded outer surface of the leveling leg. A worm gear is positioned within the housing. The worm gear is meshed with outer teeth of the spur gear. An axle is mounted to the leak pan. The axle is connected to the worm gear such that the worm gear is rotatable with the axle. Rotation of the axle is transferable to the leveling leg through the worm gear and the spur gear. The foot of the leveling leg is spaced from the threaded outer surface of the leveling leg such that the spur gear unmeshes from the threaded outer surface of the leveling leg when the leveling leg is fully retracted.

In a second example embodiment, a dishwasher appliance includes a tub. A leak pan is positioned below the tub. A leveling assembly is configured for adjusting a level of the tub. The leveling assembly includes a housing mounted to the leak pan. A leveling leg is positioned within the housing. The leveling leg has a foot. An axle is mounted to the leak pan. A gear set is positioned within the housing. The gear set is configured to transfer rotation of the axle through the gear set to the leveling leg to adjust the level of the tub. The foot of the leveling leg is spaced from a thread on an outer surface of the leveling leg such that the gear set unmeshes from the thread on the outer surface of the leveling leg when the leveling leg is fully retracted.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
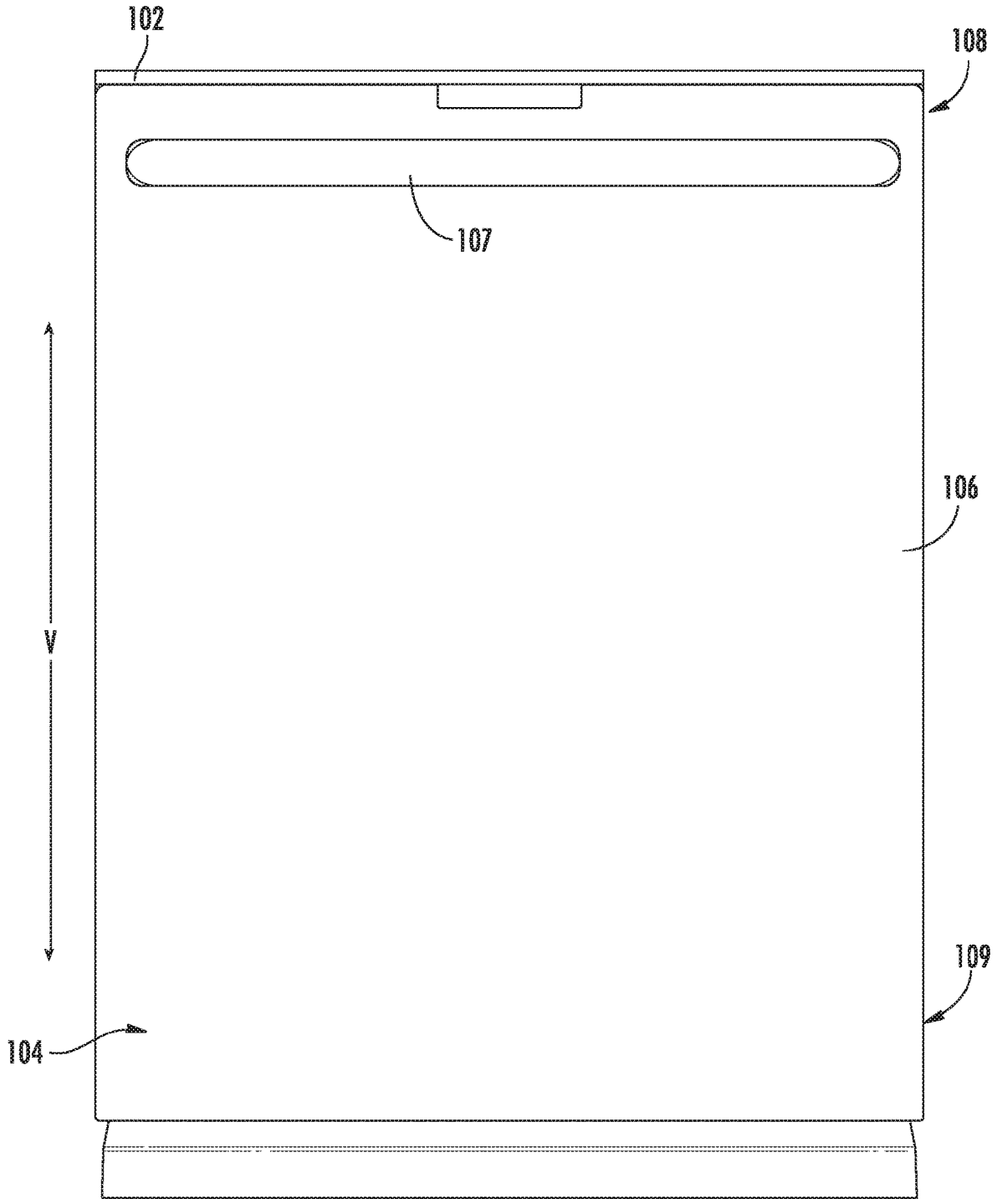
FIG. 1 is a front elevation view of a dishwasher appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts an example domestic dishwasher appliance 100 that may be configured in accordance with aspects of the present disclosure. It should be appreciated that the invention is not limited to any particular style, model, or other configuration of dishwasher, and that the embodiment depicted in FIG. 1 is for illustrative purposes only.

For the particular embodiment of FIG. 1, dishwasher appliance 100 includes a tub 102 that defines a wash chamber 104 within an interior of tub 102. Wash chamber 104 is configured for the receipt of articles for cleaning, such as dishes, cups, utensils, etc. Tub 102 includes a front opening (not shown) and a door 106 with a handle 107. Door 106 extends between a top portion 108 and a bottom portion 109 along a vertical direction V, and door 106 is hinged at or near bottom portion 109 of door 106 for movement between a normally closed vertical position (shown in FIGS. 1 and 2), wherein wash chamber 104 is sealed shut for washing operation, and a horizontal open position for loading and unloading of articles from wash chamber 104.

Dishwasher appliance 100 includes various components for applying wash fluid onto articles within wash chamber 104 and for supporting the articles within wash chamber 104. Such components are well known in the art and not shown or described in detail herein. As an example, dishwasher appliance 100 may include racks for supporting articles for washing within wash chamber 104, spray assemblies for directing flows of wash fluid onto the articles within the racks, silverware baskets, etc. The racks may be adapted for movement between an extended loading position in which the racks are substantially positioned outside wash chamber 104, and a retracted position in which the racks are located inside wash chamber 104. The spray assemblies may include rotatable spray arms mounted to tub 102 and/or one or the racks.

In general, dishwasher appliance 100 may utilize a variety of cycles to wash and, optionally, dry articles within wash chamber 104. For example, a wet cycle is utilized to wash articles. The wet cycle may include a main wash cycle and a rinse cycle, as well as an optional pre-wash cycle. During each such cycle, water or another suitable liquid may be utilized in wash chamber 104 to interact with and clean articles therein. The liquid may additionally mix with, for example, detergent or other various additives which are released into the chamber during various sub-cycles of the wet cycle. A drying cycle may be utilized to dry articles after washing. In generally, no liquid is sprayed or otherwise produced during the drying cycle.

Turning to FIGS. 2 through 14, dishwasher appliance 100 includes a leveling assembly 200 and a leak pan 300. Leveling assembly 200 is configured for adjusting a level of tub 102, e.g., front to back. For example, leveling assembly 200 may change (e.g., increase or decrease) a vertical position of a rear portion 112 of tub 102 relative to a vertical position of a front portion 114 of tub 102 in order to match such positions and account for a sloped floor below tub 102. Various features of leveling assembly 200 and leak pan 300 are discussed in greater detail below with reference to FIGS. 2 through 14.

Figure 2:
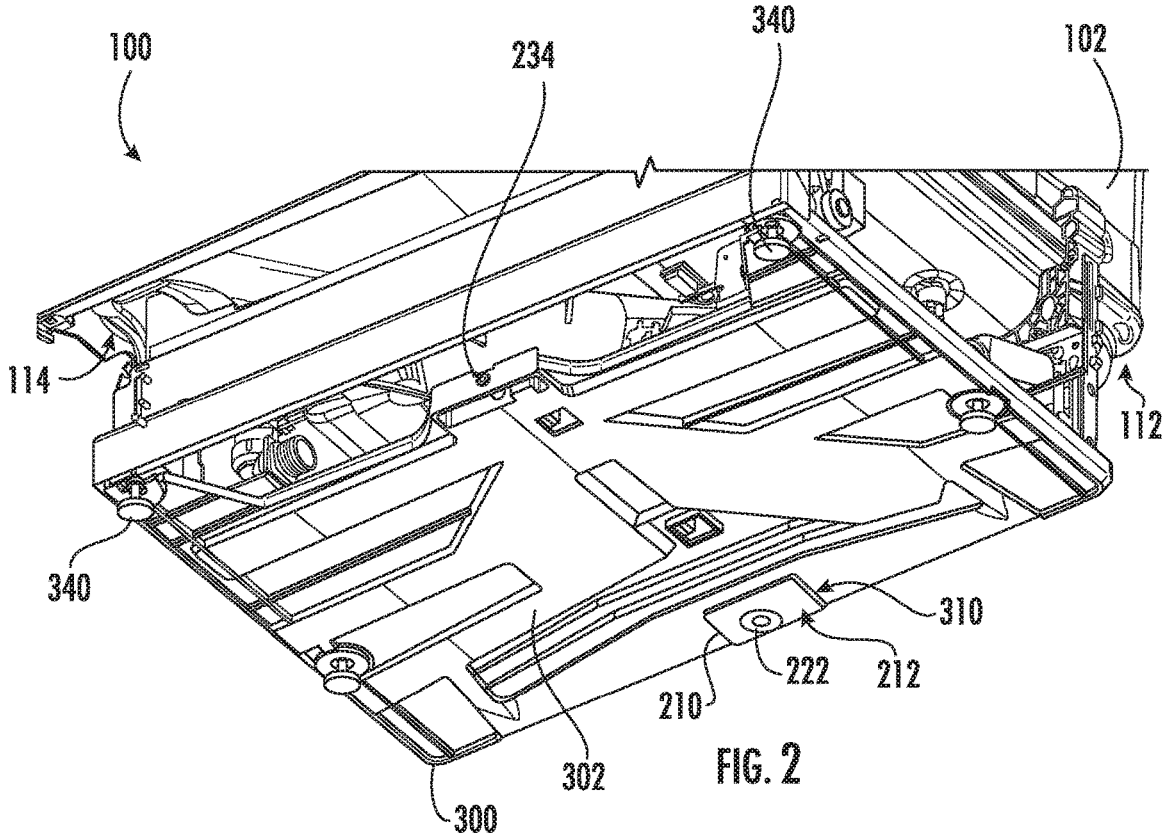
FIG. 2 is a front, partial perspective view of the example dishwasher appliance of FIG. 1.
Figure 3:
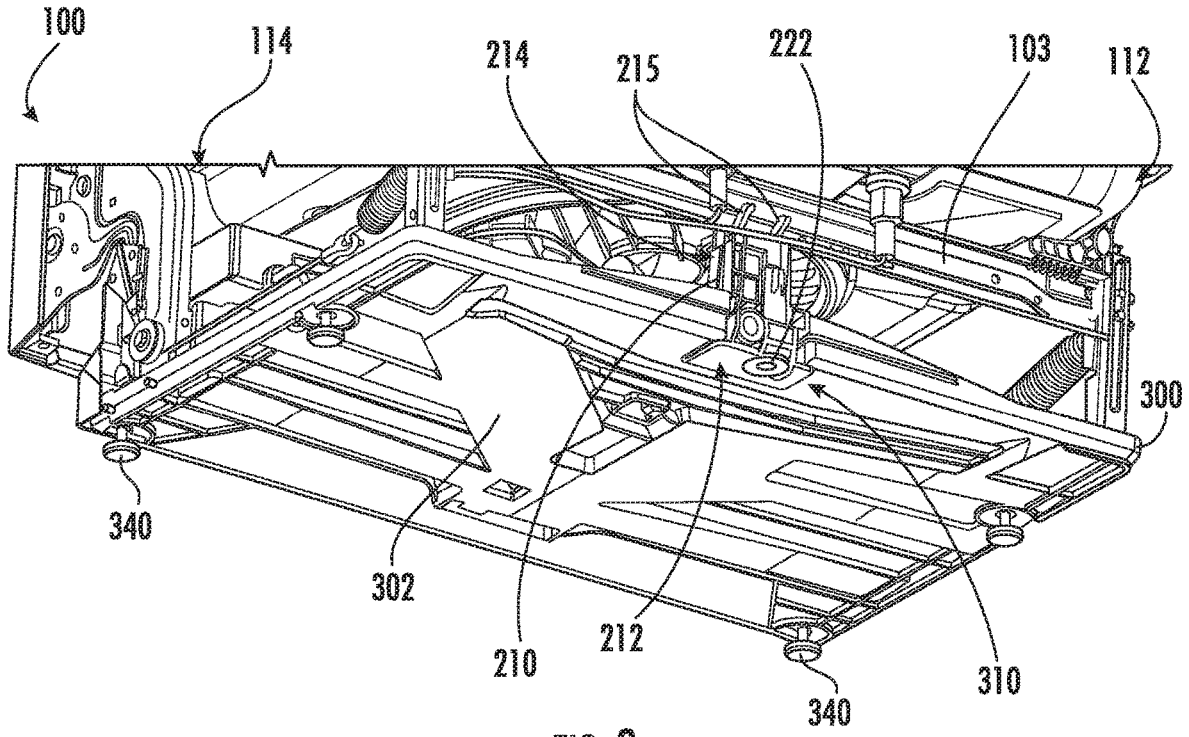
FIG. 3 is a rear, partial perspective view of the example dishwasher appliance of FIG. 1.
Figure 4:
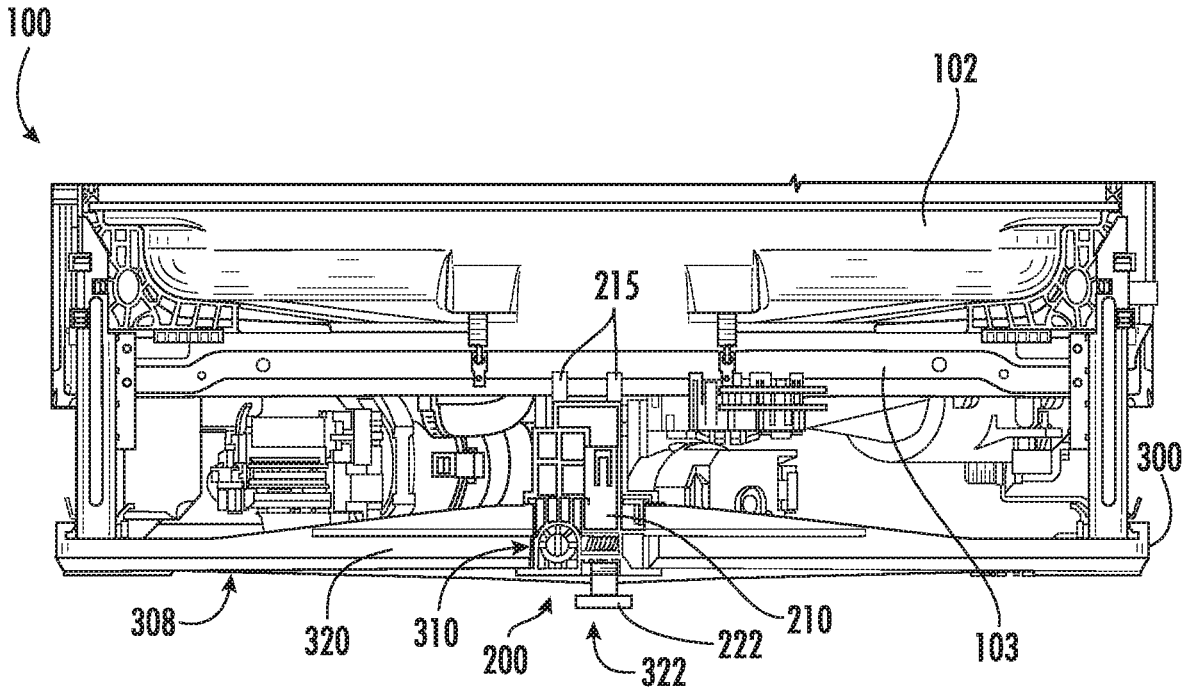
FIG. 4 is a rear, partial elevation view of the example dishwasher appliance of FIG. 1.

As shown in FIGS. 2 through 4, leak pan 300 is positioned below tub 102. Thus, leak pan 300 may catch liquids leaking from tub 102 or other components of dishwasher appliance 100 within leak pan 300, such as a drain pump, recirculation pump, filter, conduits, etc. Leak pan 300 may be sized to catch leaks from both the rear and front portions 112, 114 of tub 102. Thus, an area of leak pan 300, e.g., in a plane that is perpendicular to vertical (shown with the arrow V in FIG. 1), may be sized and shaped to complement an area of tub 102, e.g., in a plane that is perpendicular to vertical. Leak pan 300 may also include leveling legs 340 below front portion 114 of tub 102 to level front portion 114 of tub 102, e.g., side to side.

Figure 5:
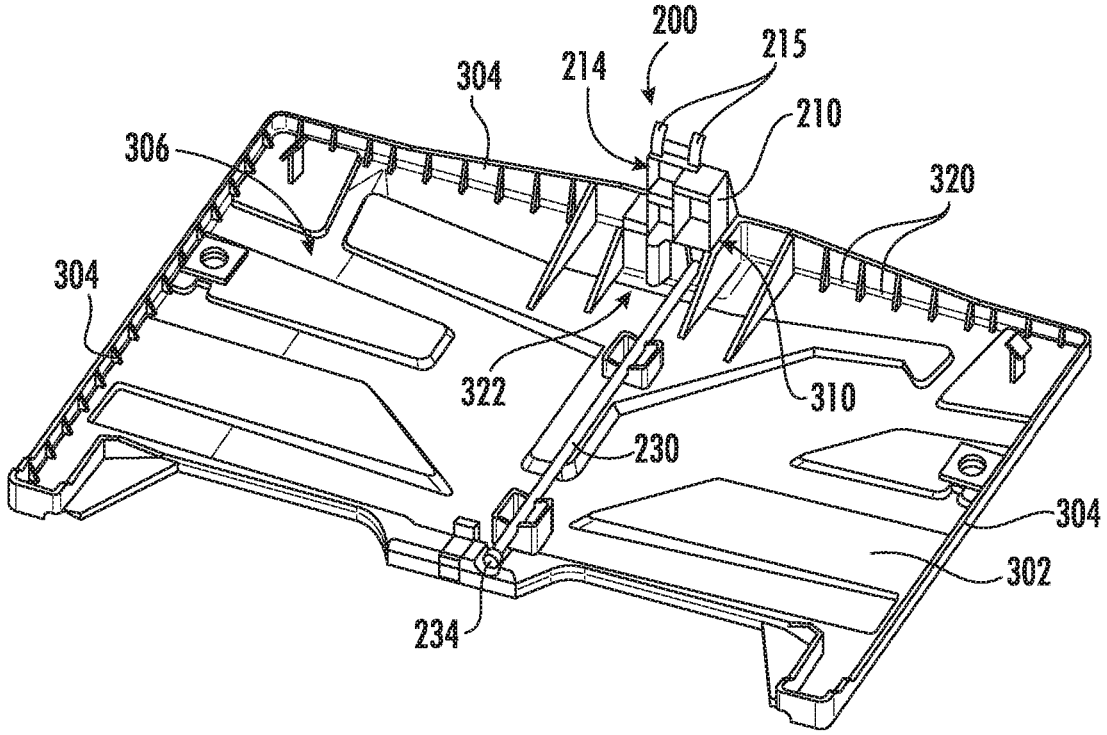
FIG. 5 is a perspective view of a leak pan and leveling assembly of the example dishwasher appliance of FIG. 1.

Leak pan 300 may be constructed of with a suitable water impermeable material, such as plastic, metal, etc. For example, in certain example embodiments, leak pan 300 may be a single piece of molded or additively formed plastic. Thus, leak pan 300 may be a molded plastic leak pan. As shown in FIG. 5, leak pan 300 may have a bottom wall 302 and one or more side walls 304 that extend around an interior 306 of leak pan 300.

Figure 6:
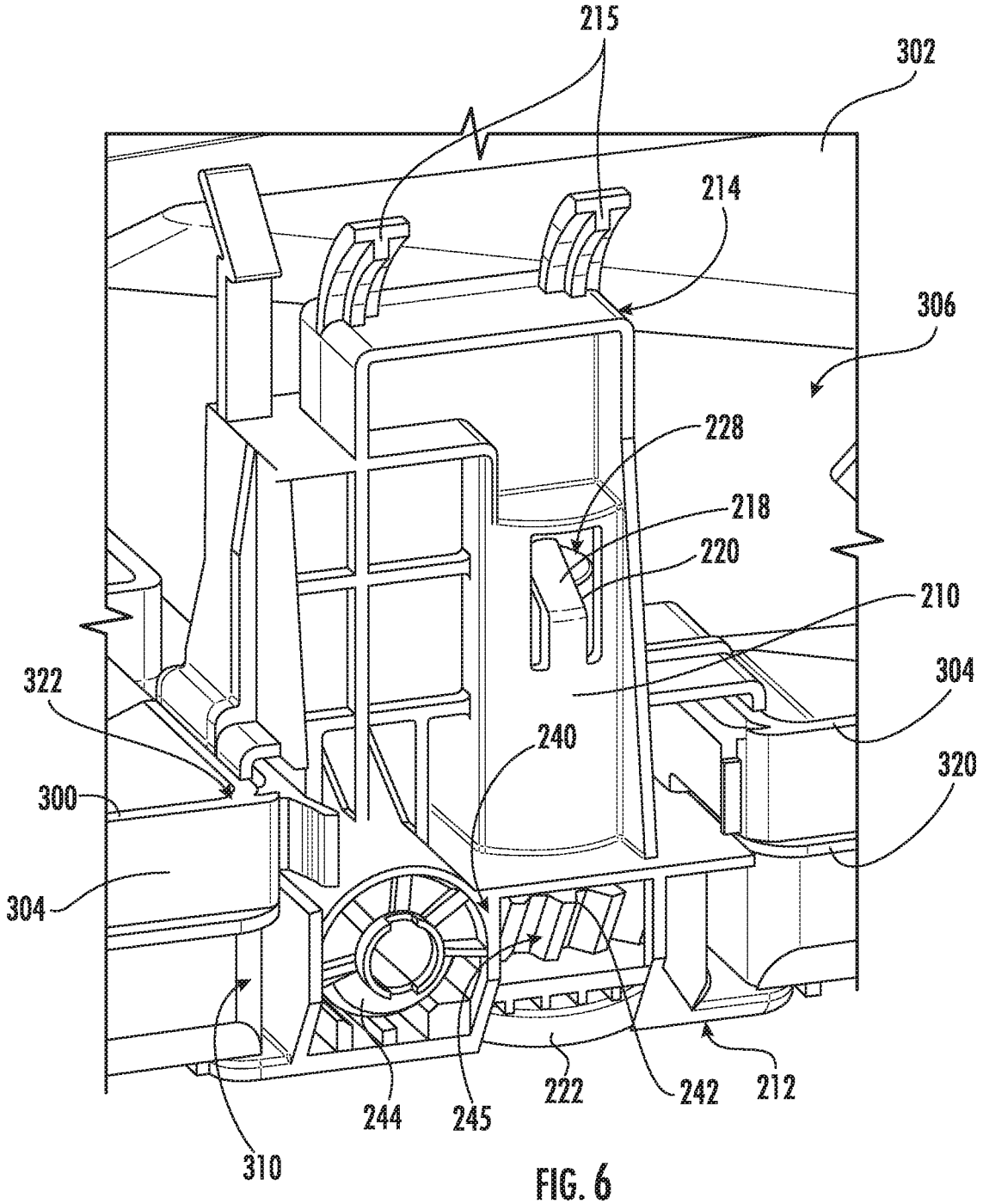
FIG. 6 is a rear, perspective view of the leveling assembly of FIG. 5.
Figure 12:
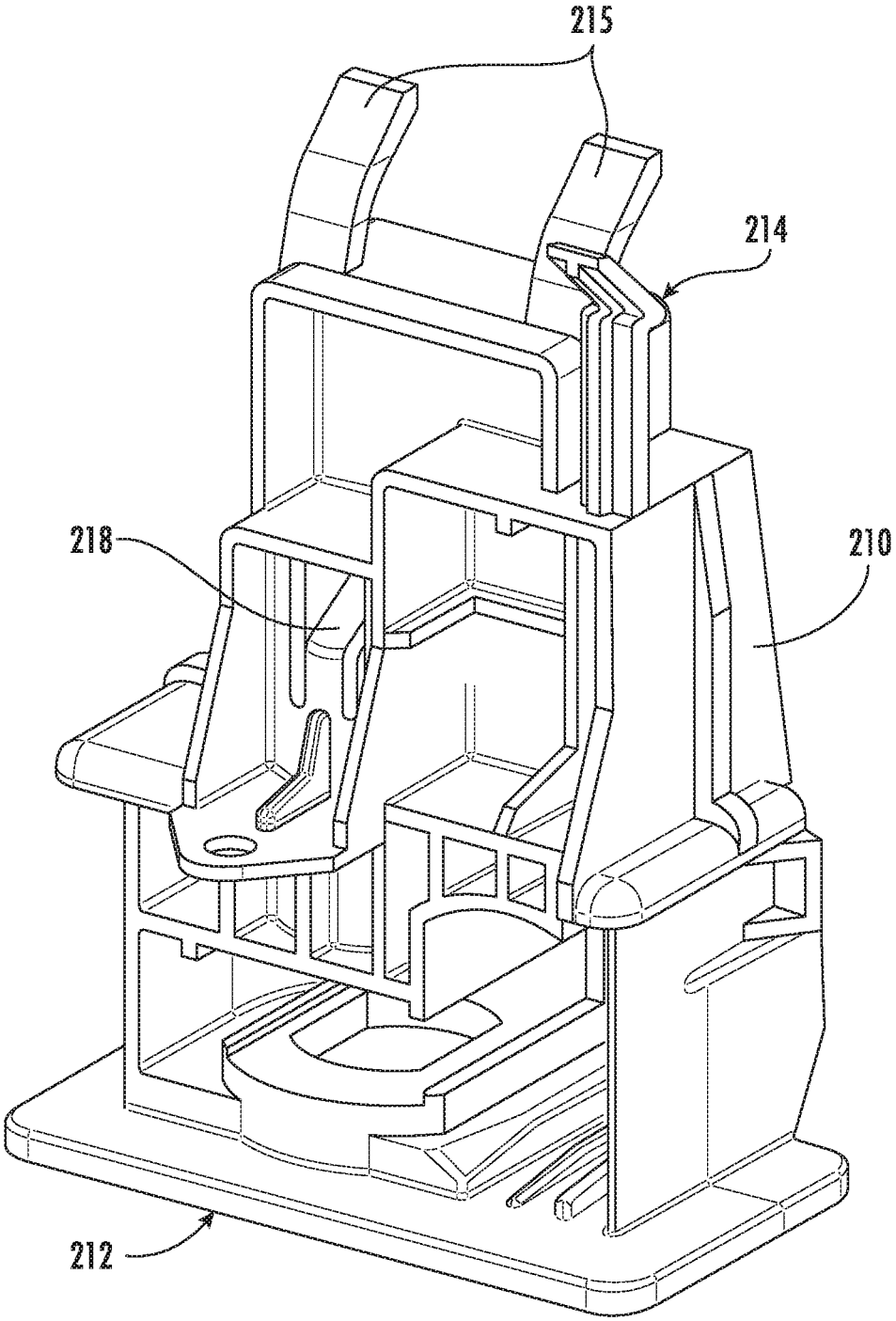
FIG. 12 is a perspective view of a housing of the leveling assembly of FIG. 5.

As shown in FIGS. 5, 6 and 12, leveling assembly 200 includes a housing 210. Housing 210 is configured to contain and support various components of leveling assembly 200. Housing 210 may be constructed of with a suitably rigid material, such as plastic, metal, etc. For example, in certain example embodiments, housing 210 may be a single piece of molded or additively formed plastic that is discrete from leak pan 300. Thus, housing 210 may be a molded plastic housing separate from the molded plastic leak pan.

Housing 210 may be mounted to leak pan 300. For example, housing 210 may be inserted into a notch 310 of leak pan 300. Notch 310 may be defined by bottom and side walls 302, 304, e.g., below rear portion 112 of tub 102. In particular, housing may be positioned at a middle portion 322 of a rear edge 320 of leak pan 300, e.g., such that the rear edge 320 of leak pan 300 extends around housing 210 at notch 310. Thus, housing 210 may be mounted to leak pan 300 below rear portion 112 of tub 102. A bottom surface 212 of housing 200 may be positioned at, e.g., level and/or coplanar with, a bottom surface 308 (FIG. 4) of leak pan 300, e.g., that is positioned opposite interior 306 of leak pan 300 about bottom wall 302.

A top portion 214 of housing 210 may be positioned on tub 102. In particular, a flange 103 of tub 102 may be received within arms 215 of housing 210 at the top portion 214 of housing 210. Thus, housing 210 may be coupled to tub 102 at top portion 214 of housing 210. Housing 210 may extend downwardly from tub 102 through leak pan 300, e.g., via notch 310, such that bottom surface 212 of housing 200 is positioned adjacent or facing a floor below leak pan 300. By extending through leak pan 300, housing 210 may assist with bearing the weight of tub 102 without leak pan 300 deforming under that weight to tub 102. In such a manner, leak pan 300 may advantageously be constructed with thin and/or flexible walls that are economical to manufacture relative to known dishwasher appliances with weight bearing base plates.

Turning to FIGS. 5 through 11, leveling assembly 200 also includes a leveling leg 220, and axle 230 and a gear set 240 (FIG. 6). Leveling leg 220 and gear set 240 may be positioned within housing 210. In particular, leveling leg 220 may be vertically slidable within housing 210, and each gear of gear set 240 may be rotatable within housing 210.

Axle 230 may be mounted to leak pan 300, as shown in FIG. 5. Turning back to FIG. 6, gear set 240 is configured to transfer rotation of axle 230 through gear set 240 to leveling leg 220 in order to adjust the level of tub 102. In particular, leveling leg 220 has a foot 222. A user may rotate axle 230 to extend or retract leveling leg 220 from housing 210 and thereby change the position of foot 222 of leveling leg 220 relative to bottom surface 212 of housing 200 and thus tub 102. In such a manner, the rear portion 112 of tub 102 may be lifted or lowered by rotating axle 230.

Gear set 240 may include a spur gear 242 and a worm gear 244. With reference to FIGS. 7 through 11, an inner thread 243 of spur gear 242 may be meshed with a threaded outer surface 224 of leveling leg 220. Worm gear 244 may be meshed with outer teeth 245 of spur gear 244, and axle 230 may be connected to worm gear 244 such that worm gear 244 is rotatable with axle 230. Thus, user rotation of axle 230 may rotate worm gear 244 that causes rotation of spur gear 242, and rotation of spur gear 242 may extend or retract leveling leg 220 from housing 210. As may be seen from the above, housing 210, leveling leg 220 and spur gear 242 may bear the rear portion 112 of tub 102.

Figure 7:
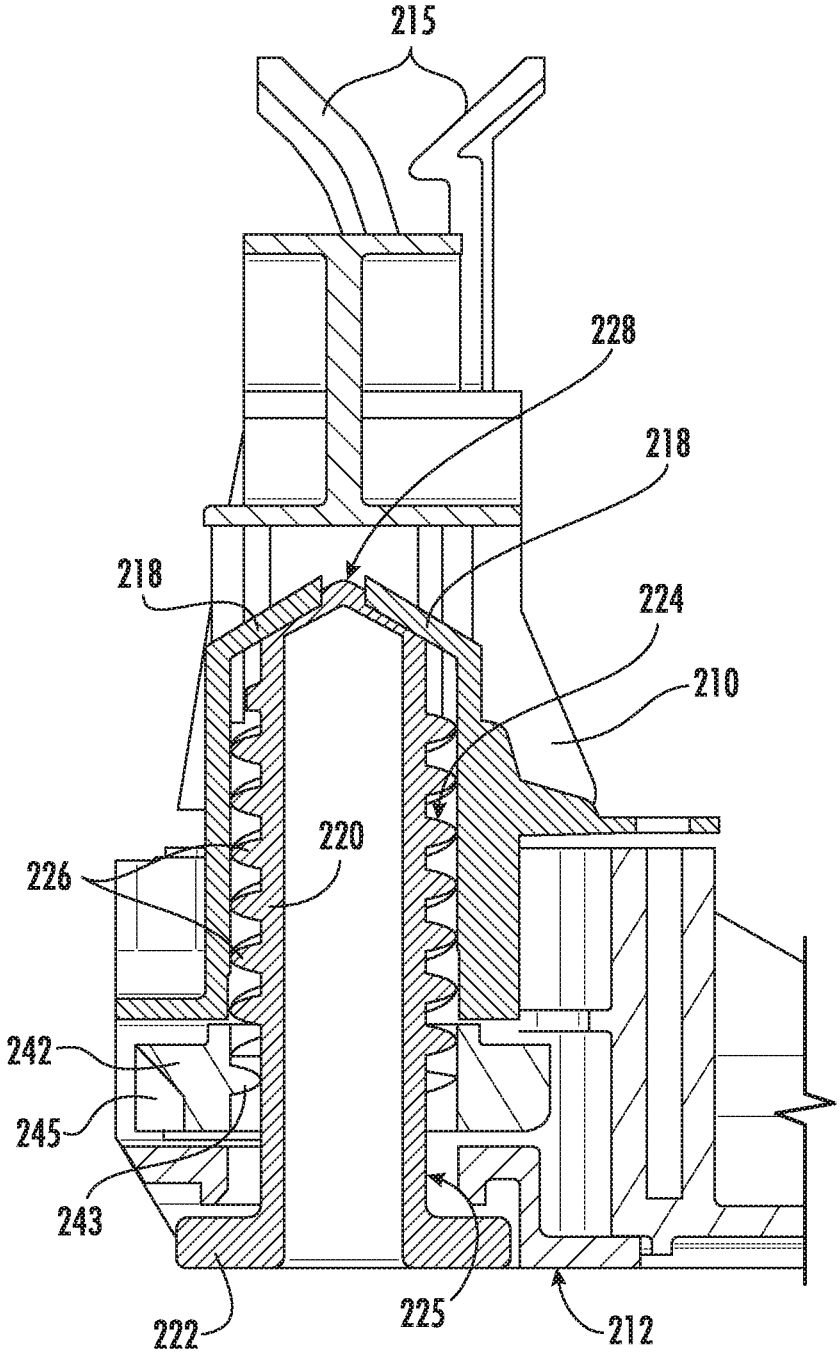
FIG. 7 is a section view of the leveling assembly of FIG. 5.
Figure 8:
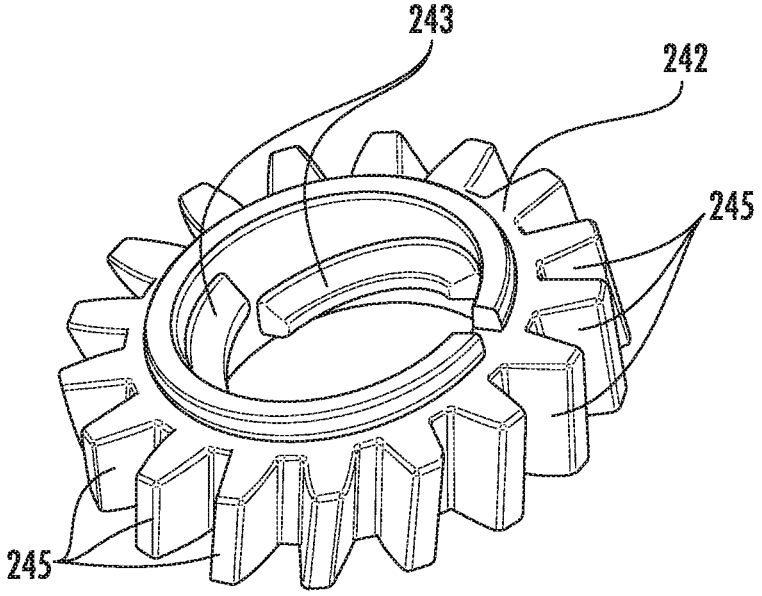
FIG. 8 is a perspective view of a spur gear of the leveling assembly of FIG. 5.
Figure 9:
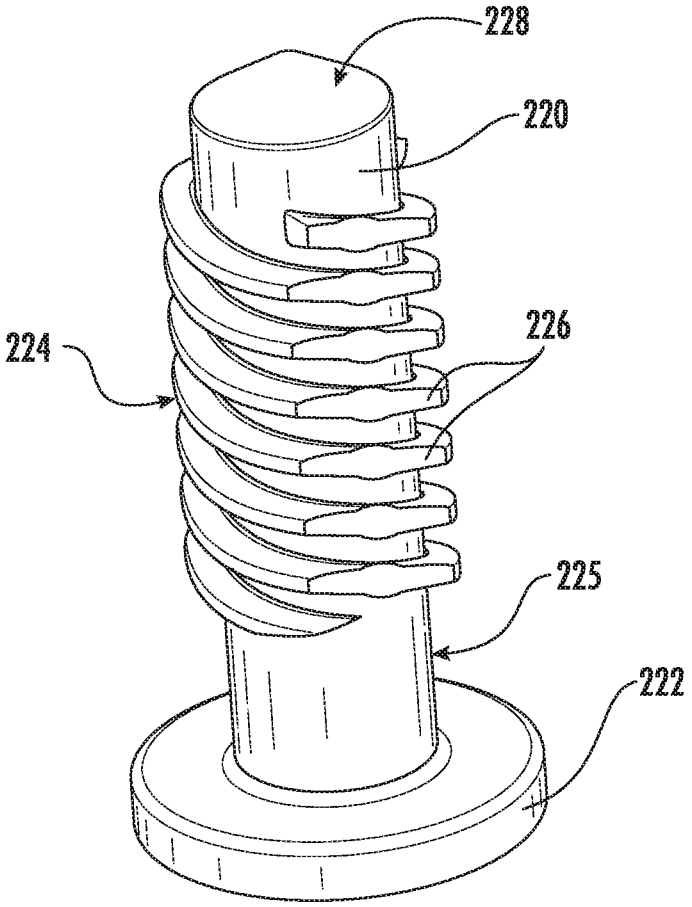
FIG. 9 is a perspective view of a leveling leg of the leveling assembly of FIG. 5.
Figure 10:
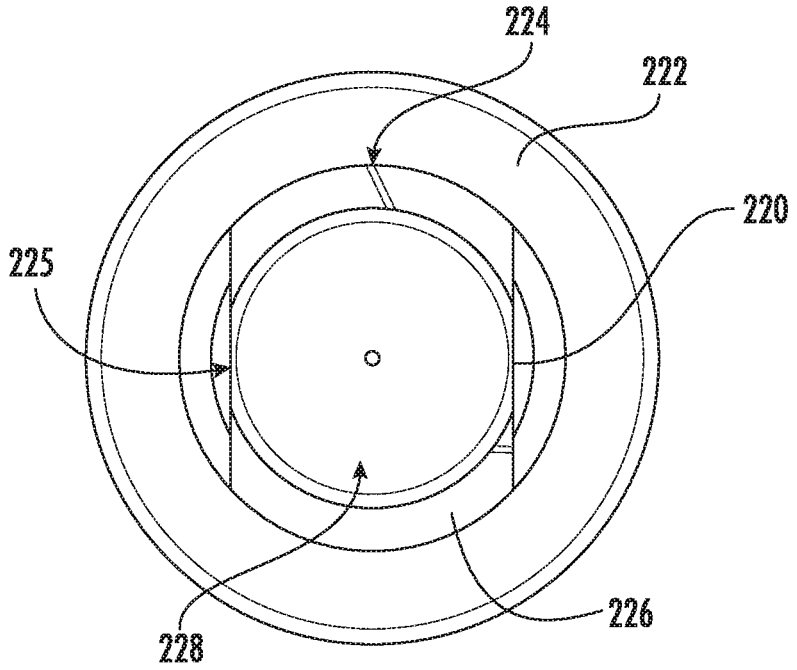
FIG. 10 is a top plan view of the leveling leg of FIG. 9.
Figure 11:
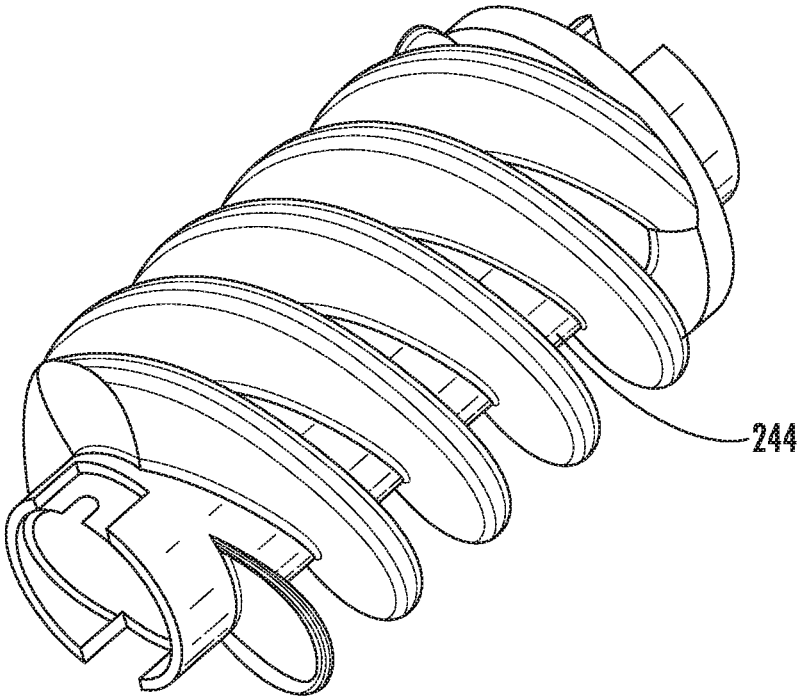
FIG. 11 is a perspective view of a worm gear of the leveling assembly of FIG. 5.

Leveling assembly 200 includes features for preventing or limiting stripping of gear set 240 by rotation of axle 230. In particular, as shown in FIGS. 7 and 9, foot 222 of leveling leg 220 may be spaced from a thread 226 on an outer surface 225 of leveling leg 220 such that gear set 240 unmeshes from thread 226 on outer surface 225 of leveling leg 220 when leveling leg 220 is fully retracted, e.g., and foot 222 is positioned against bottom surface 212 of housing 210. Thus, foot 222 of leveling leg 220 may be spaced from threaded outer surface 224 of leveling leg 220 such that spur gear 242 unmeshes from threaded outer surface 224 of leveling leg 220 when leveling leg 220 is fully retracted.

As may be seen from the above, threaded outer surface 224 of leveling leg 220 terminates or stops away from foot 222 of leveling leg 220. Thus, outer surface 225 of leveling leg 220 may be unthreaded between foot 222 of leveling leg 220 and threaded outer surface 224 of leveling leg 220. Such spacing may allow unmeshing of leveling leg 220 from gear set 240 (e.g., spur gear 242) in order to prevent stripping of threaded outer surface 224 of leveling leg 220, inner thread 243 of spur gear 242, outer teeth 245 of spur gear 244, worm gear 244, etc. In particular, a user may continue to rotate axle 230 when leveling leg 220 is fully retracted without damaging leveling assembly 200.

To allow subsequent operation, leveling assembly 200 also includes features for assisting with remeshing gear set 240 with the thread 226 on outer surface 225 of leveling leg 220, e.g., when the user rotates axle 230 to extend leveling leg 220 away from fully retracted. In particular, as shown in FIGS. 6 and 7, housing 210 includes one or more tabs 218. Tabs 218 contact a top portion 228 of leveling leg 220 when leveling leg 220 is fully retracted. In particular, tabs 218 elastically deform and urge (e.g., push) leveling leg 220 downwardly when leveling leg 220 is fully retracted, e.g., such that foot 222 of leveling leg 220 is positioned against bottom surface 212 of housing 210. By pushing leveling leg 220, tabs 218 may urge one or the gears of gear set 240 towards the thread 226 on outer surface 225 of leveling leg 220. In particular, tabs 218 may urge threaded outer surface 224 of leveling leg 220 against inner thread 243 of spur gear 242 such that leveling leg 220 meshes with spur gear 242 when the user rotates axle 230 to extend leveling leg 220 away from fully retracted. Tabs 218 maybe undeformed when leveling leg 220 is positioned away from fully retracted.

Figure 13:
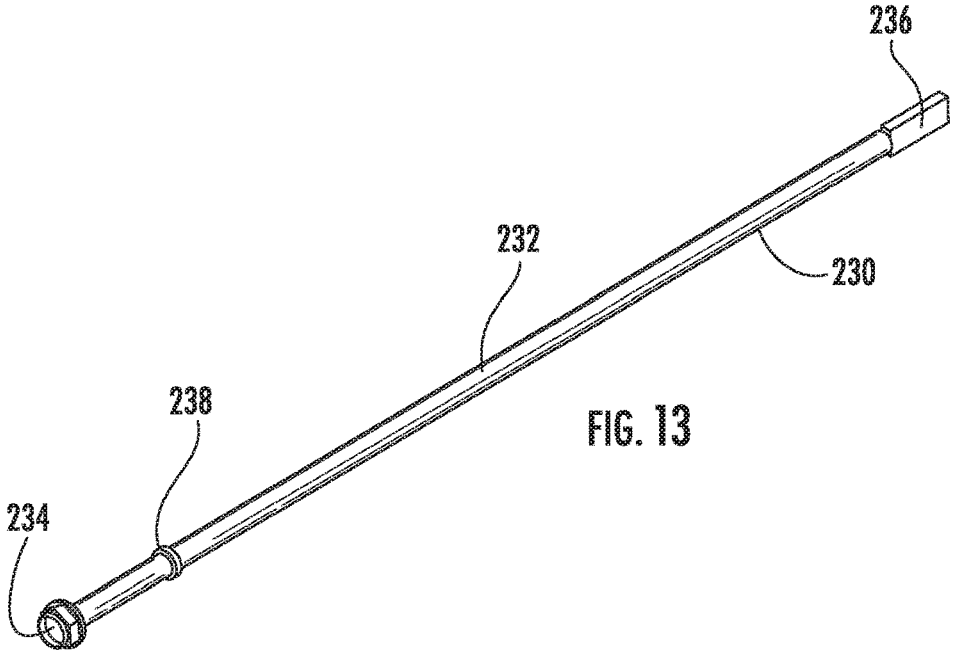
FIG. 13 is a perspective view of an axle of the leveling assembly of FIG. 5.
Figure 14:
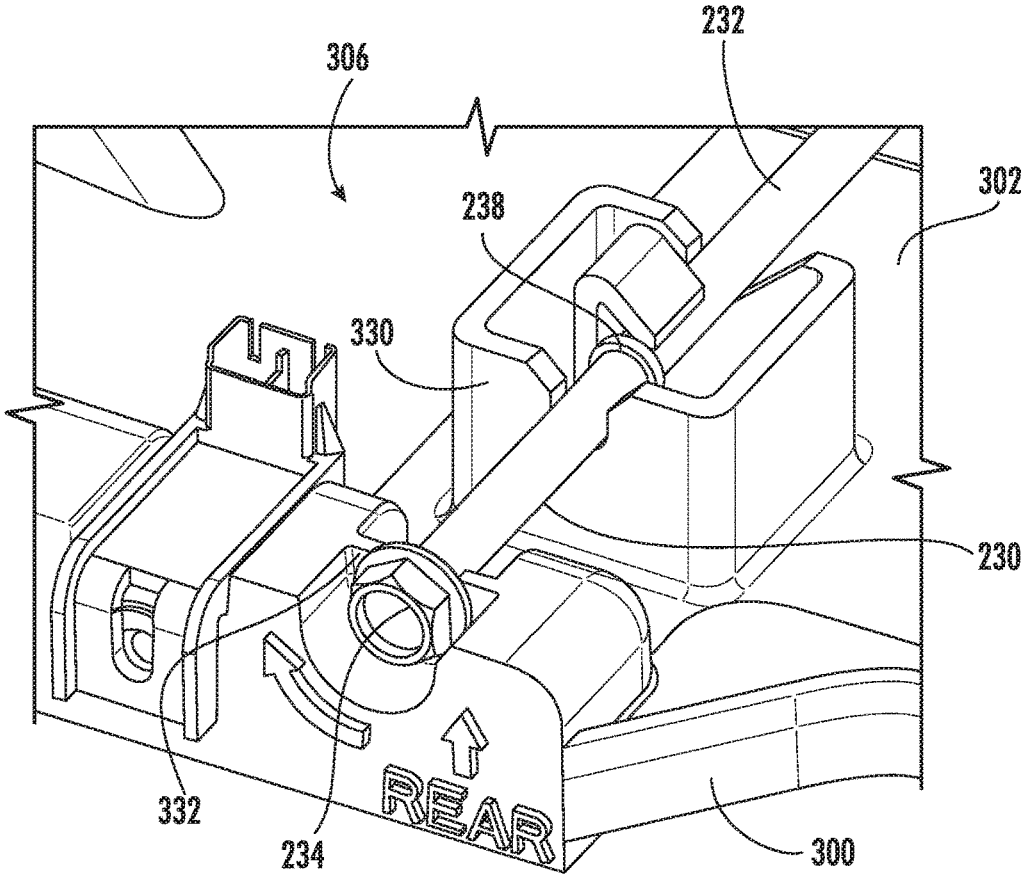
FIG. 14 is a partial perspective view of a front portion of the drain pan and the axle of the leveling assembly of FIG. 5.

Turning to FIGS. 5, 13 and 14, axle 230 may be mounted to leak pan 300 in any suitable manner. For example, axle 230 may be snap fit to leak pan 300. Axle 230 has an elongated shaft 232, an interface 234 and a connector 236. Interface 234 and connector 236 are positioned at opposite ends of elongated shaft 232. Interface 234 may be a bolt head, a screw head profile, etc. for allowing a user to engage and rotate elongated shaft 232, e.g., via a torque transmitting connection at interface 234. Interface 234 may be below front portion 114 of tub 102 to allow a user easy access to interface 234. Connector 236 may be a flat plate, a hex head, or other suitable connection for transmitting torque between axle 230 and gear set 240 (e.g., worm gear 244). Thus, e.g., connector 236 may be received within a complementary shaped shaft in worm gear 244.

Axle 230 also includes features for assisting with limiting sliding of axle 230 on leak pan 300. In particular, axle 230 includes a cold pressed washer 238 on elongated shaft 232. Cold pressed washer 238 is formed of or with the same material as elongated shaft 232. As an example, elongated shaft 232 may be plastically deformed by compressing the material of elongated shaft 232 to form cold pressed washer 238. Thus, a diameter of cold pressed washer 238 may be greater than the diameter of elongated shaft 232, e.g., between cold pressed washer 238 and interface 234.

Cold pressed washer 238 is positioned against a first wall 330 (e.g., an interior wall) of leak pan 300. Interface 234 is positioned against a second wall 332 (e.g., an exterior wall, such as one of side walls 304) of leak pan 300. Thus, first and second walls 330, 332 of leak pan 300 may be positioned between cold pressed washer 238 and interface 234. Interference of cold pressed washer 238 against first wall 330 and interface 234 against second wall 332 may limit sliding of axle 230 on leak pan 300 and/or prevent retraction of axle 230 from worm gear 244.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub;

a leak pan positioned below the tub;

a leveling assembly configured for adjusting a level of the tub, the leveling assembly comprising a housing mounted to the leak pan;

a leveling leg positioned within the housing, the leveling leg having a threaded outer surface and a foot;

a spur gear positioned within the housing, an inner thread of the spur gear meshed with the threaded outer surface of the leveling leg;

a worm gear positioned within the housing, the worm gear meshed with outer teeth of the spur gear; and an axle mounted to the leak pan, the axle connected to the worm gear such that the worm gear is rotatable with the axle, wherein rotation of the axle is transferable to the leveling leg through the worm gear and the spur gear, wherein the foot of the leveling leg is spaced from the threaded outer surface of the leveling leg, wherein an unthreaded outer surface of the leveling leg is positioned between the foot of the leveling leg and the threaded outer surface of the leveling leg, and wherein the inner thread of the spur gear is positioned at the unthreaded outer surface of the leveling leg and is unmeshed from the threaded outer surface of the leveling leg when the leveling leg is fully retracted.

2. The dishwasher appliance of claim 1, wherein the housing is mounted to the leak pan below a rear portion of the tub.

3. The dishwasher appliance of claim 2, wherein a bottom surface of the housing is positioned at a bottom surface of the leak pan, and a top portion of the housing is positioned on the tub.

4. The dishwasher appliance of claim 2, wherein the axle has a user interface positioned below a front portion of the tub.

5. The dishwasher appliance of claim 1, wherein the housing comprises one or more tabs that contact a top portion of the leveling leg such that the one or more tabs elastically deform and urge the leveling leg downwardly when the foot of the leveling leg is positioned against the housing.

6. The dishwasher appliance of claim 1, wherein the housing is positioned at a middle portion of a rear edge of the leak pan.

7. The dishwasher appliance of claim 6, wherein the housing extends downwardly from the tub such that the housing, the spur gear and the leveling leg bear a rear portion of the tub.

8. The dishwasher appliance of claim 7, wherein the rear edge of the leak pan extends around the housing.

9. The dishwasher appliance of claim 1, wherein the axle is snap fit to the leak pan, the axle has a cold pressed washer positioned against a first wall of the leak pan, the axle has a user interface positioned against a second wall of the leak pan, and the first and second walls of the leak pan are positioned between the cold pressed washer and the user interface.

10. The dishwasher appliance of claim 9, wherein the user interface of the axle is positioned below a front portion of the tub.

11. The dishwasher appliance of claim 1, wherein the leak pan is a molded plastic leak pan, the housing is a molded plastic housing, and the molded plastic housing is inserted into a notch of the molded plastic leak pan.

12. A dishwasher appliance, comprising:

a tub;

a leak pan positioned below the tub;

a leveling assembly configured for adjusting a level of the tub, the leveling assembly comprising a housing mounted to the leak pan;

a leveling leg positioned within the housing, the leveling leg having a foot;

an axle mounted to the leak pan;

a gear set positioned within the housing, the gear set configured to transfer rotation of the axle through the gear set to the leveling leg to adjust the level of the tub;

wherein the foot of the leveling leg is spaced from a thread the leveling leg, wherein an unthreaded outer surface of the leveling leg is positioned between the foot of the leveling leg and the thread on the leveling leg, and wherein a gear of the gear set is positioned at the unthreaded outer surface of the leveling leg and is unmeshed from the thread on the outer surface of the leveling leg when the leveling leg is fully retracted.

13. The dishwasher appliance of claim 12, wherein the housing is mounted to the leak pan below a rear portion of the tub, a bottom surface of the housing is positioned at a bottom surface of the leak pan, a top portion of the housing is positioned on the tub, and the axle has a user interface positioned below a front portion of the tub.

14. The dishwasher appliance of claim 12, wherein the housing comprises one or more tabs that contact a top portion of the leveling leg such that the one or more tabs elastically deform and urge the leveling leg downwardly when the foot of the leveling leg is positioned against the housing.

15. The dishwasher appliance of claim 12, wherein the housing is positioned at a middle portion of a rear edge of the leak pan, and the housing extends downwardly from the tub such that the housing, one or more gears of the gear set and the leveling leg bear a rear portion of the tub.

16. The dishwasher appliance of claim 12, wherein the axle is snap fit to the leak pan, the axle has a cold pressed washer positioned against a first wall of the leak pan, the axle has a user interface positioned against a second wall of the leak pan, and the first and second walls of the leak pan are positioned between the cold pressed washer and the user interface.

17. The dishwasher appliance of claim 12, wherein the leak pan is a molded plastic leak pan, the housing is a molded plastic housing, and the molded plastic housing is inserted into a notch of the molded plastic leak pan.

18. The dishwasher appliance of claim 1, wherein the foot of the leveling leg is positioned against a bottom surface of the housing when the leveling leg is fully retracted.

19. The dishwasher appliance of claim 1, wherein the housing and the leak pan are formed from discrete pieces of material, a top portion of the housing is positioned on the tub, and the housing extends downwardly from the tub through the leak pan such that a bottom surface of the housing is positioned at a bottom surface of the leak pan.

* * * * *